US008172964B2

(12) United States Patent
Gash et al.

(10) Patent No.: US 8,172,964 B2
(45) Date of Patent: May 8, 2012

(54) PYROPHORIC METAL-CARBON FOAM COMPOSITES AND METHODS OF MAKING THE SAME

(75) Inventors: Alexander E. Gash, Brentwood, CA (US); Joe H. Satcher, Jr., Patterson, CA (US); Randall L. Simpson, Livermore, CA (US); Theodore F. Baumann, Discovery Bay, CA (US); Marcus A. Worsley, Belmont, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 232 days.

(21) Appl. No.: 12/329,437

(22) Filed: Dec. 5, 2008

(65) Prior Publication Data

US 2010/0139823 A1 Jun. 10, 2010

(51) Int. Cl.

| | |
|---|---|
| ***C06B 45/00*** | (2006.01) |
| ***C06B 45/04*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/17; 149/2; 149/87; 149/108.2; 149/109.2; 149/109.6

(58) Field of Classification Search ..... 149/17, 149/2, 87, 108.2, 109.2, 109.4, 109.6
See application file for complete search history.

(56) References Cited

U.S. PATENT DOCUMENTS

| | | | | |
|---|---|---|---|---|
| 3,970,003 | A * | 7/1976 | Hayward et al. | 102/336 |
| 4,435,481 | A | 3/1984 | Baldi | 428/550 |
| 4,694,036 | A | 9/1987 | Baldi | 524/473 |
| 4,708,913 | A | 11/1987 | Baldi | 428/607 |
| 4,815,386 | A * | 3/1989 | Dillard et al. | 102/364 |
| 4,824,482 | A | 4/1989 | Baldi | 75/254 |
| 4,970,114 | A * | 11/1990 | Baldi | 428/326 |
| 5,464,699 | A | 11/1995 | Baldi | 428/607 |
| 6,296,678 | B1 | 10/2001 | Merzbacher et al. | 44/542 |
| 7,247,259 | B2 * | 7/2007 | Erkey et al. | 252/518.1 |
| 2007/0060573 | A1 * | 3/2007 | Wortmann et al. | 514/218 |

FOREIGN PATENT DOCUMENTS

| | | |
|---|---|---|
| WO | 91/07242 | 5/1991 |

OTHER PUBLICATIONS

U.S. Appl. No. 11/165,734, filed Jun. 24, 2005.

Merzbacher et al., "Thermally Emitting Iron Acrogel Composites" Technical Report, Naval Research Laboratory; Sep. 29, 2000; NRL/MR/1004-00/8490.

Simpson et al. "Final Report 2003: Safe and Environmentally Acceptable Sol-Gel-Derived Pyrophoric Pyrotechnics" Lawrence Livermore National Laboratory; UCRL-TR-204902.

* cited by examiner

*Primary Examiner* — James McDonough

(74) *Attorney, Agent, or Firm* — Zilka-Kotab, PC

(57) ABSTRACT

A method for creating a pyrophoric material according to one embodiment includes thermally activating a carbon foam for creating micropores therein; contacting the activated carbon foam with a liquid solution comprising a metal salt for depositing metal ions in the carbon foam; and reducing the metal ions in the foam to metal particles. A pyrophoric material in yet another embodiment includes a pyrophoric metal-carbon foam composite comprising a carbon foam having micropores and mesopores and a surface area of greater than or equal to about 2000 $m^2/g$, and metal particles in the pores of the carbon foam. Additional methods and materials are also disclosed.

33 Claims, 4 Drawing Sheets

PYROPHORIC METAL-CARBON FOAM COMPOSITES AND METHODS OF MAKING THE SAME

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to pyrophorics, and more particularly to pyrophoric metal-carbon foam composites and methods of making the same.

BACKGROUND

Pyrotechnics can be grouped into at least six families: decoy flares, illuminating flares, colored flares, smokes, igniters/starters and miscellaneous pyrotechnic items. Decoy flares include infrared (IR) and solid pyrophoric flares. Aircraft pyrophoric decoy flares are typically solid pyrotechnic devices ejected as a precautionary measure or in response to a missile warning system. The most significant requirement of the device is that it develops a high-intensity, characteristic signature rapidly. In order to meet this requirement, the energy radiated by the flare is typically provided by a pyrotechnic reaction. Pyrotechnic compositions have been shown to provide high energy densities and reasonable storage life at moderate cost. The most common composition of a typical pyrotechnic flare consists of pyrophoric iron. This composition provides the high energy density desired for the decoy and also produces solid combustion products for good radiation efficiency. The net reaction of these flares is shown in Equation 1:

$$2Fe(s)+3/2O_2 \rightarrow Fe_2O_3(s)+\text{heat} \qquad \text{Equation 1}$$

Decoy materials of this composition undergo the above reaction to reach temperatures of about 820° C. in less than about one second and above about 750° C. for about twelve seconds after their exposure to air. The thermal response can be increased or decreased with the addition of metals that undergo very exothermic reactions when heated in air (e.g., B, Al, Zr, Ti, etc.) or inert metal oxides (e.g., $SiO_2$, $Al_2O_3$, etc.), respectively.

A typical pyrophoric decoy flare is composed of pyrophoric iron coated onto steel foil. The pyrophoric iron coating is usually prepared by mixing Fe and Al powders in a slurry containing a suitable solvent and binder. A very thin steel foil is then coated with the slurry by either dip coating or spraying. The resulting material is then rapidly heated to 500° C. to drive off the solvent and binder to yield a coating of the metallic powders. The coated substrate is then heated to relatively high temperatures (about 800° C.-1000° C.) in both $H_2$ and Ar atmospheres to from an iron/aluminum alloy. The resulting alloy can be leached with a hot (about 100° F.-200° F.) caustic aqueous solution of about 10-20% sodium hydroxide (by mass) to leach the aluminum from the alloy and render the remaining iron porous and highly pyrophoric. Some prior processes claim that use of stannite (dissolved as $SnCl_2$ or Sn(s)) in the aqueous leaching solution increases the activity (i.e., makes the iron more pyrophoric) and the lifetime of the active decoy. There are several variations of the described manufacturing technique that allow the preparation of the pyrophoric iron as a powder or a coating on a metal foil. Pyrophoric foils are particularly attractive for their ability to be dispersed from the aircraft in a cloud-like pattern. The high surface area to mass ratio of the foils causes them to flutter after being ejected from the aircraft and take on the appearance of a moving hot cloud when several decoys are ejected in rapid succession. This signal is attractive to the IR-seeking missile. Current pyrophoric decoy composition and performance can be modified through manipulation of the manufacturing process.

Having a small amount of a substance in intimate contact with the pyrophoric iron that undergoes an exothermic reaction when heated can increase the pyrophoric action of the decoy flare material. Metals, such as boron or titanium, can be added to the pyrophoric foils to achieve this desired result. Alternatively, the pyrophoric iron can be coated with aqueous solutions of commercially available alumina or silica sol that coat the porous base metal. The inert oxide coating blocks $O_2$ from getting to the iron too rapidly and hence slows down the burn rate and makes the pyrophoric response of the material less intense. The pyrophoric iron generated by the above processes can be stored in solvents such as acetone, ethanol, and methanol, under certain conditions, with little loss in their pyrophoric performance. The current process relies heavily upon the use of hot caustic leaching solutions to prepare the high surface area porous pyrophoric Fe metal. These solutions are corrosive and represent both a safety and environmental hazard.

Production of pyrophoric iron in a simple and safe manner would be advantageous from a safety and environmental point of view. Therefore, it would be desirable to achieve pyrophoric activity in a material that is safer to process and more environmentally friendly, while still achieving similar pyrophoric activity as is seen in pyrophoric iron produced via conventional techniques.

SUMMARY

A method for creating a pyrophoric material according to one embodiment includes thermally activating a carbon foam for creating micropores therein; contacting the activated carbon foam with a liquid solution comprising a metal salt for depositing metal ions in the carbon foam; and reducing the metal ions in the foam to metal particles.

A method for creating a pyrophoric material according to another embodiment includes forming a carbonaceous gel using a sol-gel chemistry process; pyrolyzing the gel for producing a primarily macroporous carbon foam; thermally activating the carbon foam for creating micropores therein; contacting the activated carbon foam with a liquid solution comprising a metal salt for depositing metal ions in the carbon foam; and reducing the metal ions in the foam to metal particles.

A method for creating a pyrophoric material according to yet another embodiment includes contacting a carbon foam with a solution comprising a metal alkoxide or a solution comprising a metal salt and a proton scavenger, for forming an interpenetrating network of metal oxide gel in the carbon foam; drying the gel; and pyrolyzing for reducing the metal oxide network to a native metal thereof.

A method for creating a pyrophoric material according to a further embodiment includes contacting a carbon foam with a solution comprising a metal alkoxide or a solution comprising a metal salt and a proton scavenger for forming an interpenetrating network of metal oxide gel in the carbon foam, the metal oxide comprising at least one of titanium and iron; drying the gel using supercritical extraction; and pyrolyzing for reducing the metal oxide network to a native metal thereof.

A pyrophoric material in yet another embodiment includes a pyrophoric metal-carbon foam composite comprising a carbon foam having micropores and mesopores and a surface area of greater than or equal to about 2000 $m^2/g$, and metal particles in the pores of the carbon foam.

Other aspects and embodiments of the present invention will become apparent from the following detailed description, which, when taken in conjunction with the drawings, illustrate by way of example the principles of the invention.

DETAILED DESCRIPTION

Figure 1:
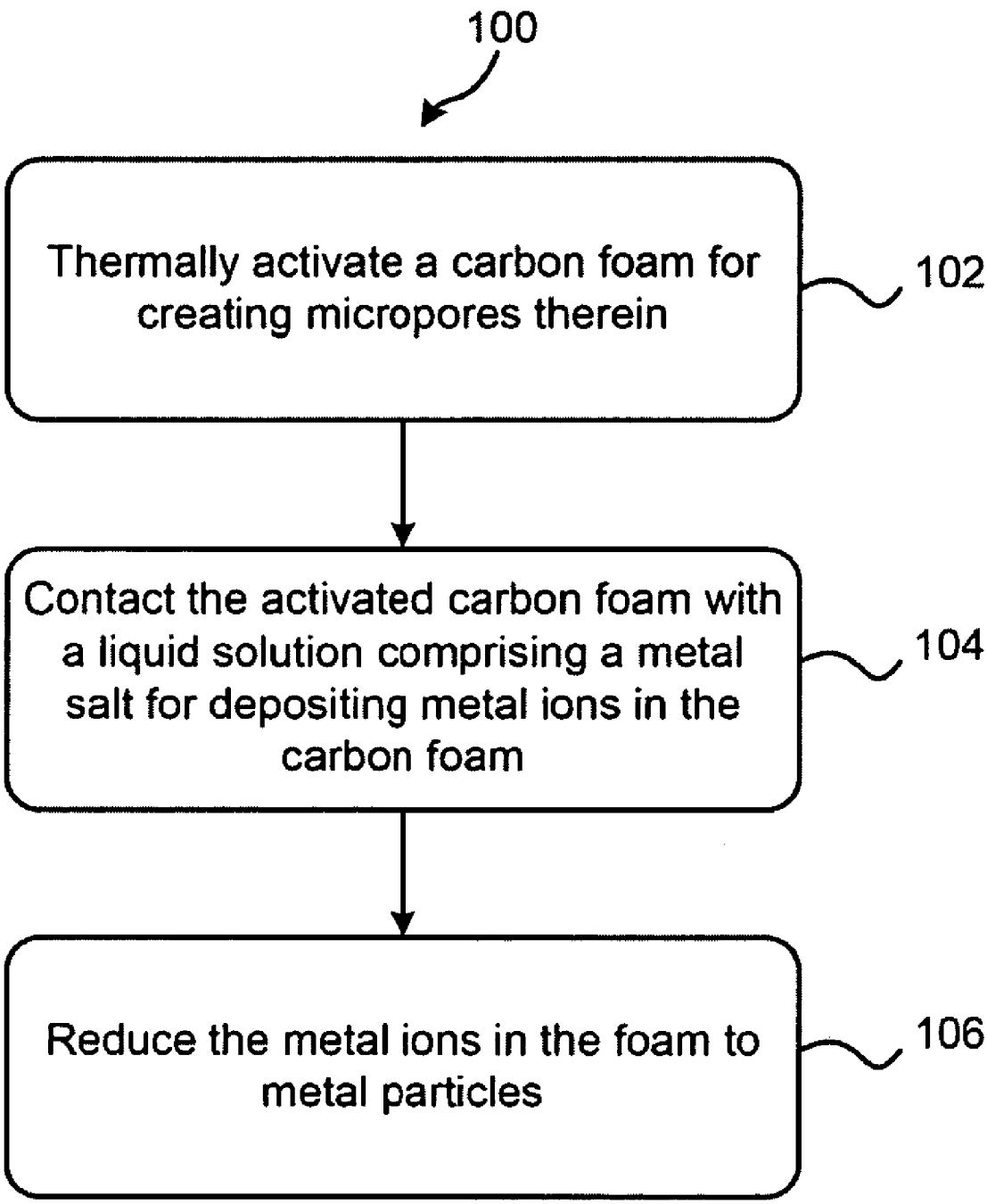
FIG. 1 is a flowchart of a method for creating a pyrophoric material according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically-defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In a general embodiment, a method for creating a pyrophoric material includes thermally activating a carbon foam for creating micropores therein; contacting the activated carbon foam with a liquid solution comprising a metal salt for depositing metal ions in the carbon foam; and reducing the metal ions in the foam to metal particles.

In another general embodiment, a method for creating a pyrophoric material includes forming a carbonaceous gel using a sol-gel chemistry process; pyrolyzing the gel for producing a primarily macroporous carbon foam; thermally activating the carbon foam for creating micropores therein; contacting the activated carbon foam with a liquid solution comprising a metal salt for depositing metal ions in the carbon foam; and reducing the metal ions in the foam to metal particles.

In another general embodiment, a method for creating a pyrophoric material includes contacting a carbon foam with a solution comprising a metal alkoxide or a solution comprising a metal salt and a proton scavenger (such as propylene oxide, etc.) for forming an interpenetrating network of metal oxide gel in the carbon foam; drying the composite gel; and pyrolyzing for reducing the metal oxide network to the native metal.

In another general embodiment, a method for creating a pyrophoric material includes contacting a carbon foam with a solution comprising a metal alkoxide or a solution comprising a metal salt and a proton scavenger (such as propylene oxide, etc.) for forming an interpenetrating network of metal oxide gel in the carbon foam, the metal oxide comprising at least one of titanium and iron; drying the gel using supercritical extraction; and pyrolyzing for reducing the metal oxide network to the native metal.

In a further general embodiment, a pyrophoric material comprises a pyrophoric metal-carbon foam composite comprising a carbon foam having micropores, mesopores and a surface area of greater than or equal to about 2000 $m^2/g$, and metal particles in the pores of the carbon foam.

As a basic introduction, sol-gel chemistry utilizes the hydrolysis and condensation of molecular chemical precursors, in solution, to produce nanometer-sized primary particles, called "sols". Through further condensation the "sols" are linked to form a three-dimensional solid network, referred to as a "gel," with the solvent liquid present in its pores. Evaporation of the liquid phase results in a dense porous solid referred to as a "xerogel". Supercritical extraction of the pore liquid eliminates the surface tension of the retreating liquid phase and results in solids called, "aerogels". Sol-gel materials are distinctive in that they typically posses high surface areas, high porosities and small primary particle size. The properties unique to sol-gel materials lead to their enhanced reactivity. Therefore, sol-gel chemical routes are very attractive because they offer low temperature routes to synthesize homogeneous materials with variable compositions, morphologies, and densities.

In certain embodiments, "sol-gel" methodology is used to produce nanostructured energetic materials (i.e., pyrotechnics) while minimizing or eliminating the health and environmental hazards associated with their current fabrication. This sol-gel approach for preparing pyrotechnic formulations involves a fundamental change in the conventional manufacturing and fabrication processes of energetic materials. One particular application of this methodology can be used to eliminate the use of caustic leaching solutions associated with pyrophoric decoy flare manufacture, while maintaining improving performance of the final products. Low temperature reduction of high surface area porous sol-gel-derived iron(III)oxide with molecular hydrogen may result in the formation of porous pyrophoric iron metal, suitable for use in pyrophoric decoy flares.

In further embodiments, sol-gel techniques may also be used to produce a substrate for immobilization of the pyrophoric material in the flare and allow suitable dispersion when deployed. The extremely versatile nature of sol-gel chemistry may ultimately allow for the reformulation of materials that is not possible or practical with current systems, to allow decoy flares with special features to be readily and safely prepared.

In some embodiments, sol-gel techniques may enable high control over chemical compositions, particle size and distribution, and reaction rates. In addition, sol-gel techniques may be safer than existing processing techniques.

Generic Methods

Pyrophoric metal-carbon composites may be prepared using several methods, including the first and second generic methods described in detail below. Each generic method involves the synthesis of a macroporous carbon using sol-gel chemistry, metal-impregnation of the carbon foam, and reduction of the impregnated metal. Additional and/or alternative processing steps may take place between, before, or after any of the steps listed below, and the steps may be performed in any order. Moreover, where already-prepared materials are obtained, certain steps may be eliminated. The first generic method to prepare a metal-carbon composite, according to some embodiments, is as follows.

1) Monolithic macroporous organic gels may be prepared using sol-gel chemistry through the acid- or base-catalyzed polymerization of a precursor such as a hydroxylated arene (such as a hydroxyl benzene derivative, e.g., resorcinol (m-dihydroxybenzene); phenol; etc.), etc. and an aldehyde (such as formaldehyde, acetaldehyde, etc.) in water or some suitable nonaqueous solvent. Any acid/base may be used, such as acetic acid, hydrochloric acid, sodium bicarbonate, potassium carbonate, amines, etc. In particularly preferred embodiments, acetic acid, resorcinol, and formaldehyde are used. The acid catalyzed materials are highly porous with high specific surface areas just as are base catalyzed materials. However, acid catalyzed materials have particularly strong mechanical properties, which is likely the result of the rigid column-like microstructure. Acid catalyzed materials are strong enough to enable liquid impregnation and subsequent drying without cracking or shattering of the monolithic structure.

2) Drying of the organic gel may be achieved through evaporation under ambient conditions or super-critical drying of the solvent to obtain a monolithic, macroporous organic foam. Specifically, the foam may be monolithic, or in some other form, such as a laminate, a powder, a film, etc.

3) The monolithic organic foam may be pyrolyzed in an inert atmosphere, e.g., nitrogen ($N_2$), argon (Ar), etc., to produce a monolithic, macroporous carbon foam.

4) The carbon monolith may be thermally activated at an elevated temperature, such as greater than about 800° C. to about 900° C., with a heated gas, such as carbon dioxide ($CO_2$) gas, steam ($H_2O$), etc., to create a foam with a bimodal pore structure (micropores and macropores) through physical erosion of the carbon. This step may increase the overall surface area of the carbon foam to a value of greater than or equal to about 2000 $m^2/g$ through the creation of microporosity, pores with sizes generally less than 2 nm. The foam may, and most likely will, include micropores, mesopores, and macropores. Micropores are generally less than about 2 nm in size, mesopores are generally between about 2 and about 50 nm in size, and macropores are generally larger than about 50 nm in size. In some embodiments, the foam is substantially macroporous, i.e., including mostly macropores.

5) Liquid impregnation is used to deposit the metal in the pores of the carbon foam. In one approach, the activated carbon foam may be treated with an aqueous or nonaqueous metal salt solution to impregnate the high surface area carbon structure with the desired metal salt. For example, an inorganic metal salt may be dissolved in a suitable solvent, which wets the porous carbon structure. In some approaches, the metal component may be any metal which, when finely divided, oxidizes. Illustrative metals include iron, platinum, titanium, nickel, tin, and zirconium. Particularly preferred metal salts are inorganic metal salts of Iron(III). In some approaches, combinations of metal salts may be used and/or sequentially applied to create multicomponent metal deposits.

6) The metal salt-impregnated activated carbon foam may be dried as in step 2) above. This removes the solvent, leaving the metal ions in the pores of the carbon foam.

7) The impregnated carbon foam may be heated in the presence of a chemical reductant, e.g., hydrogen gas ($H_2$), carbon monoxide (CO), etc. in an inert carriers such as argon or nitrogen, lithium (Li), sodium (Na), etc., to reduce the metal ions to metal particles. The resulting metal-carbon composite is a pyrophoric metal-carbon foam composite that is pyrophoric, burning spontaneously upon exposure to air. In particularly preferred embodiments, the metal particles comprise greater than about 3% by weight (wt %), preferably greater than about 6 wt %, and ideally greater than about 12 wt %.

8) The resulting carbon foam may be kept under inert atmospheric conditions, such as nitrogen, argon, etc., to inhibit spontaneous burning when exposed to air.

In a second generic method, according to some embodiments, pyrophoric metal-carbon composites were prepared using a process that involves the synthesis of a macroporous carbon using sol-gel chemistry with metal-impregnation of the carbon foam, and reduction of the impregnated metal. The steps are as follows.

1) Monolithic macroporous organic gels may be prepared using sol-gel chemistry through the acid- or base-catalyzed polymerization of a precursor such as a hydroxylated arene (such as a hydroxyl benzene derivative, e.g., resorcinol (m-dihydroxybenzene); phenol; etc.), etc. and an aldehyde (such as formaldehyde, acetaldehyde, etc.) in water or some suitable nonaqueous solvent. Any acid/base may be used, such as acetic acid, hydrochloric acid, sodium bicarbonate, potassium carbonate, amines, etc. In particularly preferred embodiments, acetic acid, resorcinol, and formaldehyde are used. The acid catalyzed materials are highly porous with high specific surface areas just as are base catalyzed materials. However, acid catalyzed materials have particularly strong mechanical properties, which is likely the result of the rigid column-like microstructure. Acid catalyzed materials are strong enough to enable liquid impregnation and subsequent drying without cracking or shattering of the monolithic structure.

2) Drying of the organic gel may be achieved through evaporation under ambient conditions or preferably through super-critical drying of the solvent to obtain a monolithic, macroporous organic foam. Specifically, the foam may be monolithic, or in some other form, such as a laminate, a powder, a film, etc.

3) The monolithic organic foam may be pyrolyzed in an inert atmosphere, e.g., nitrogen ($N_2$), argon (Ar), etc., to produce a monolithic, macroporous carbon foam.

4) Titanium (Ti) or some other suitable metal may be added, generally in combination with an alkoxide (such as ethoxide, methoxide, etc.) or metal salt (such as titanium tetrachloride, etc.) dissolved in a suitable solvent (such as ethanol, methanol, etc.), and possibly some other constituents, such as water, acid, base, etc., in an ice bath or other cooling environment, to create an interpenetrating network. For purposes of illustrating the general method, titanium will be used as the exemplary metal in the following description, it being understood that other metals may be used. Generally, the addition of propylene oxide or some other suitable alkoxide results in the creation of a titania sol.

5) The exposure of the titania sol under vacuum to a carbon aerogel monolith, after curing for about 24 hours, results in wet titania-carbon composite, which may be washed with acetone or other agent for removing impurities including excess water, and dried through evaporation under ambient conditions or super-critical drying of the solvent to obtain a monolithic, macroporous organic foam. Specifically, the foam may be monolithic, or in some other form, such as a powder, a film, etc.

6) The monolithic organic foam may then be pyrolyzed in an inert atmosphere, e.g., nitrogen ($N_2$), argon (Ar), etc., to produce a monolithic, macroporous carbon foam.

The processes to create a metal-carbon composite have been described using gases, generally, but in some embodiments, liquids having proper mechanical and chemical properties may be used in any of the steps in the first or second generic methods.

With reference to the above described generic methods, FIGS. 1-4 are described in detail. Now referring to FIG. 1, a method 100 for creating a pyrophoric material is shown according to one embodiment. Method 100 may be carried out in any desired environment, particularly those in the first and second generic methods described above. In addition, more or less steps may be included in method 100 as desired.

With continued reference to FIG. 1, in operation 102, a carbon foam may be thermally activated, preferably at elevated temperatures, for creating micropores therein in accordance with generic methods 1 and 2 above.

In operation 104, the activated carbon foam may be contacted with a liquid solution comprising a metal salt, such as Ti or Pt, for depositing metal ions in the carbon foam. Any method of contacting may be used, including spraying, depositing, soaking, splashing, etc.

In operation 106, the metal ions may be reduced in the foam to metal particles, through any appropriate technique, such as heating the foam in the presence of a chemical reductant, such as hydrogen gas ($H_2$), carbon monoxide gas (CO), lithium (Li), sodium (Na), etc.

Figure 2:
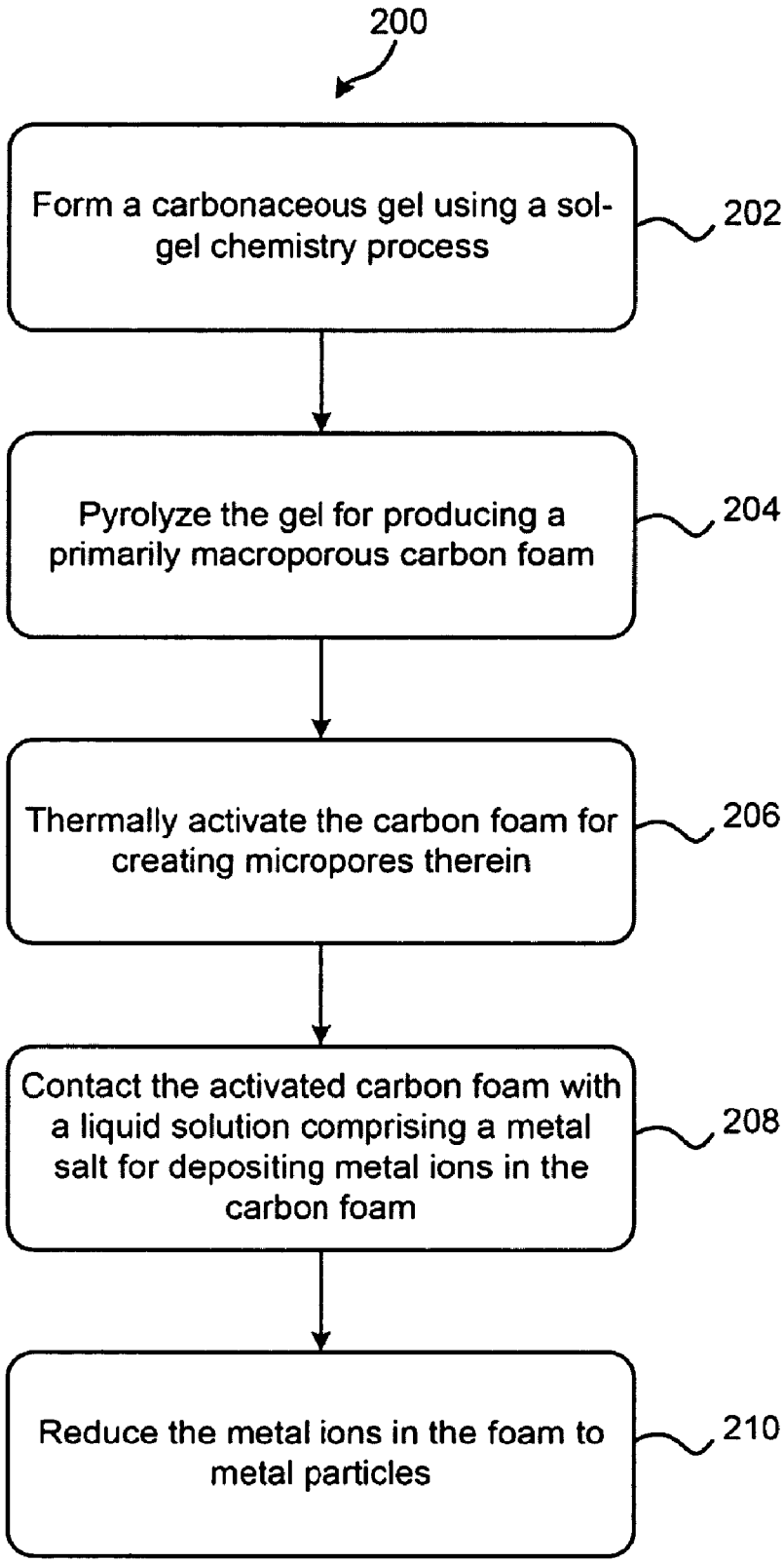
FIG. 2 is a flowchart of a method for creating a pyrophoric material according to one embodiment.

Now with reference to FIG. 2, another method for creating a pyrophoric material is shown according to one embodiment. Method 200 may be carried out in any desired environment, particularly those described in the first and second generic methods above. In addition, more or less steps may be included in method 200 as desired.

In operation 202, a carbonaceous gel may be formed using a sol-gel chemistry process, such as those described in the first and second generic methods.

In operation 204, the gel may be pyrolyzed for producing a primarily macroporous carbon foam. Macropores are generally larger than about 50 nm in size.

In operation 206, the carbon foam may be thermally activated, preferably at elevated temperatures, for creating micropores therein in accordance with generic methods 1 and 2 above.

In operation 208, the activated carbon foam may be contacted with a liquid solution comprising a metal salt, such as Ti, Pt, etc., for depositing metal ions in the carbon foam. Any method of contacting may be used, including spraying, depositing, soaking, splashing, etc.

In operation 210, the metal ions may be reduced in the foam to metal particles, through any appropriate technique, such as heating the foam in the presence of a chemical reductant, such as hydrogen gas ($H_2$), carbon monoxide gas (CO), lithium (Li), sodium (Na), etc.

Figure 3:
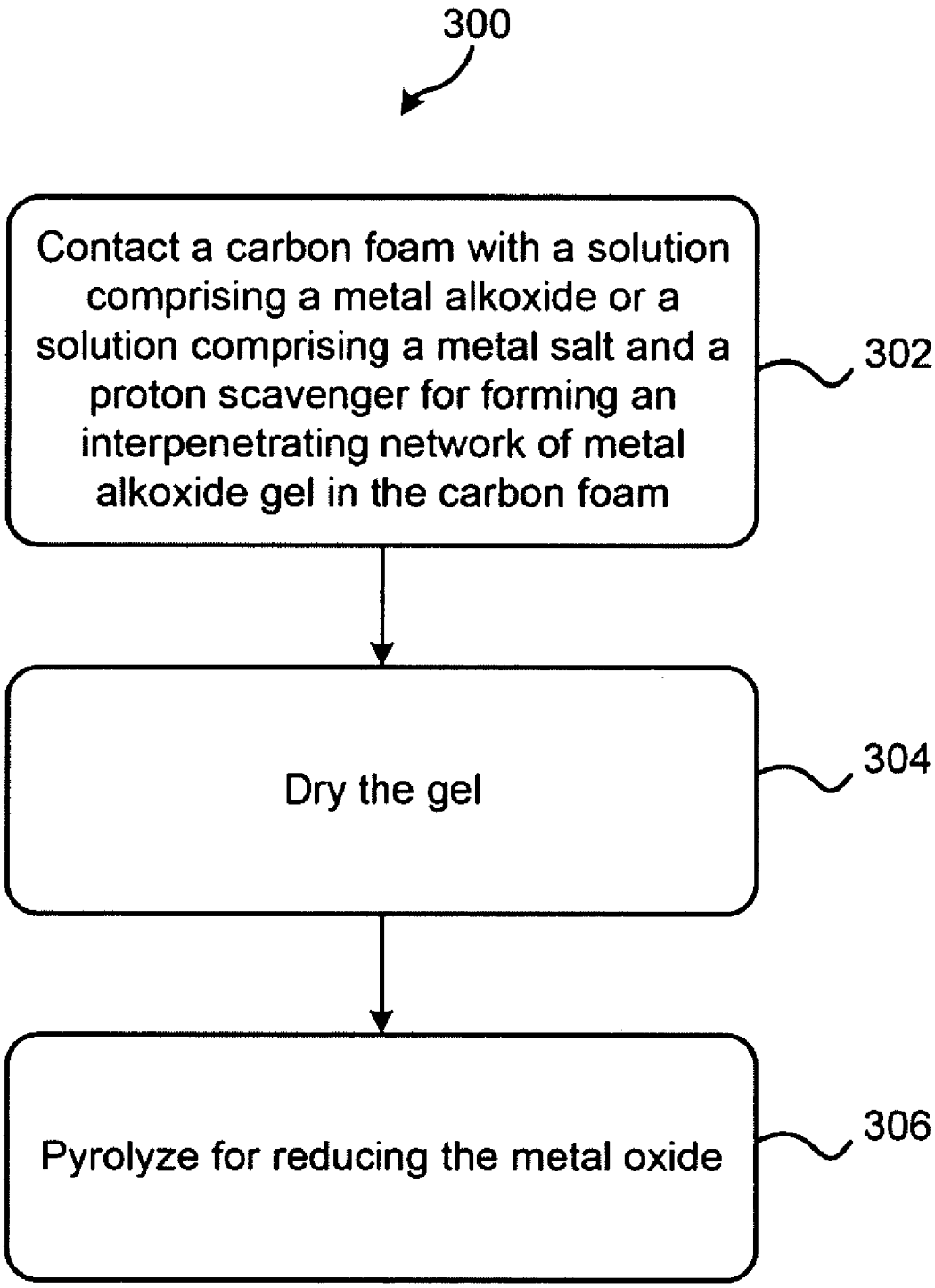
FIG. 3 is a flowchart of a method for creating a pyrophoric material according to one embodiment.

Now with reference to FIG. 3, another method for creating a pyrophoric material is shown according to one embodiment. Method 300 may be carried out in any desired environment, particularly those described in the first and second generic methods above. In addition, more or less steps may be included in method 300 as desired.

In operation 302, a carbon foam may be contacted with a solution comprising a metal alkoxide, such as titanium isopropoxide ($Ti\{OCH(CH_3)_2\}_4$), aluminum isopropoxide ($Al\{OCH(CH_3)_2\}_3$), etc., or a solution comprising a metal salt and a proton scavenger such as propylene oxide, etc, for forming an interpenetrating network of metal oxide gel in the carbon foam. Any method of contacting may be used, including spraying, depositing, soaking, splashing, etc.

In operation 304, the gel may be dried through any appropriate technique, such as ambient drying, supercritical extraction, etc. A metal oxide network remains after the drying.

In operation 306, the gel may be pyrolyzed for reduction of the metal oxide network to a native metal thereof, in accordance with the first and second generic methods.

Figure 4:
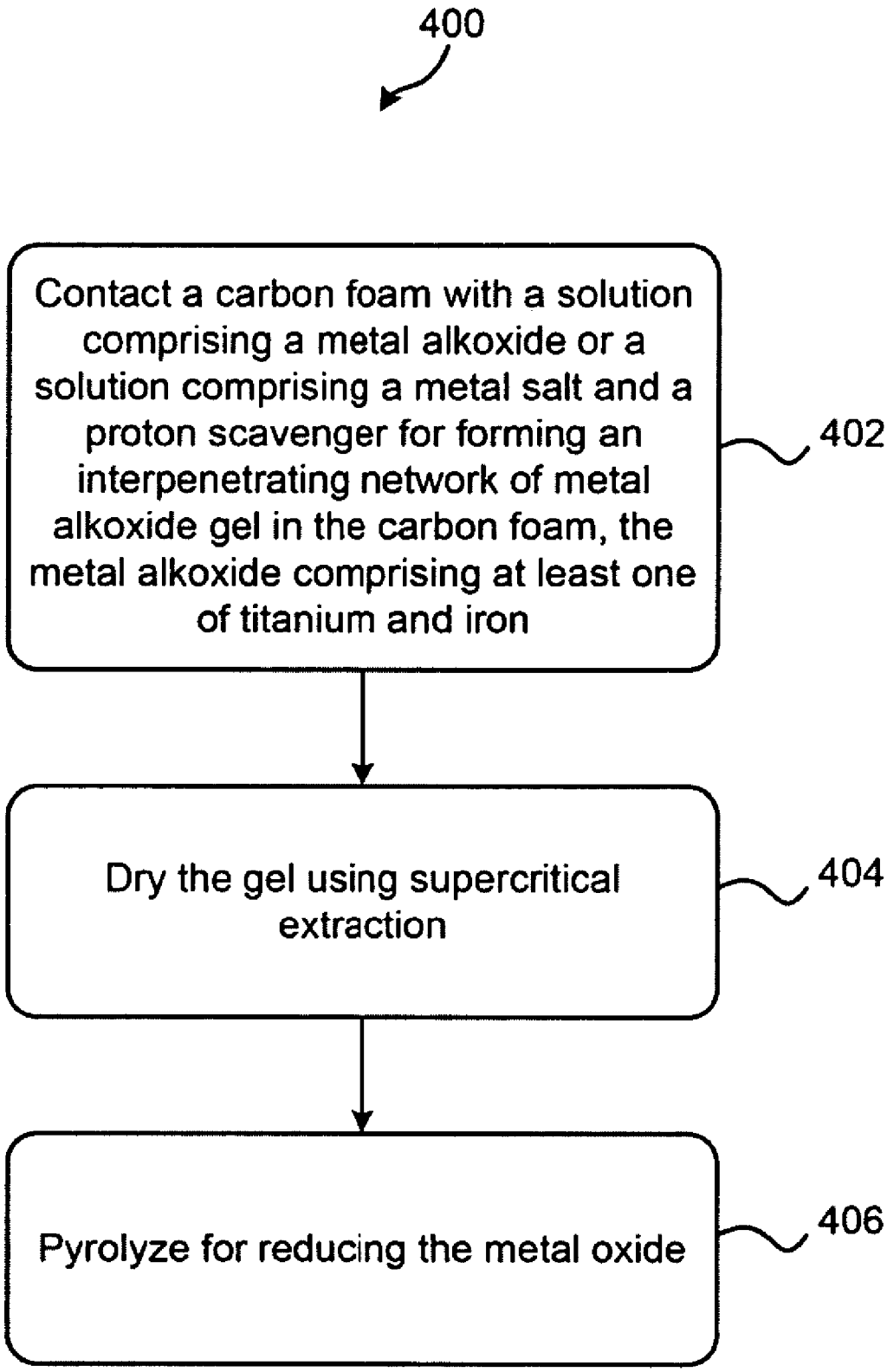
FIG. 4 is a flowchart of a method for creating a pyrophoric material according to one embodiment.

Now with reference to FIG. 4, another method for creating a pyrophoric material is shown according to one embodiment. Method 400 may be carried out in any desired environment, particularly those described in the first and second generic methods above. In addition, more or less steps may be included in method 400 as desired.

In operation 402, a carbon foam may be contacted with a solution comprising a metal alkoxide, such as titanium isopropoxide ($Ti\{OCH(CH_3)_2\}_4$), iron ethoxide ($Fe(OC_2H_5)_3$), etc., or a solution comprising a metal salt and a proton scavenger such as propylene oxide for forming an interpenetrating network of metal oxide gel in the carbon foam, the metal oxide comprising at least one of titanium and iron. Any method of contacting may be used, including spraying, depositing, soaking, splashing, etc.

In operation 404, the gel may be dried, preferably through supercritical extraction.

In operation 406, the gel may be pyrolyzed for reduction of the metal oxide network to a native metal thereof, in accordance with the first and second generic methods.

SPECIFIC EXAMPLES

Pyrophoric metal-carbon composites were prepared using processes that involve the synthesis of a macroporous carbon using sol-gel chemistry, and possibly activation and metal-impregnation of the carbon foam, and possibly reduction of the impregnated metal. The steps used to prepare these metal-carbon composites are described above in the first and second generic methods.

Specific Example

Monolithic Iron-Carbon Composite

The following process was used to prepare a pyrophoric iron-carbon composite. This same process can be used to fabricate other pyrophoric composites with metals such as nickel (Ni) and platinum (Pt). In a typical experiment, resorcinol (12.3 g, 0.112 mol) and 37% formaldehyde solution (17.9 g, 0.224 mol) were dissolved in water (15 mL), followed by the addition of glacial acetic acid (0.44 g, 0.007 mol). The reaction mixture was then transferred to glass molds and cured at 80° C. for 72 hours. The resultant organic hydrogels, isolated as bright orange monoliths, were washed with acetone until the water was completely exchanged and then dried under ambient conditions. The organic aerogels were carbonized at 1050° C. for 3 hours under a nitrogen atmosphere and then activated with carbon dioxide (10 sccm) at 950° C. The soak time used during the activation step (between 3 hours and 6 hours) determined the specific surface area of the activated carbon foam. The activated carbon foam was then treated with an aqueous iron nitrate solution (for example, 1.0 M $Fe(NO_3)_3.9H_2O$ in $H_2O$) for 18 hours to ensure uniform impregnation of the iron salt in the carbon monolith. The metal-impregnated carbon foam was dried under a stream of nitrogen (500 sccm). The resultant monolith was then treated with 40% hydrogen gas (40 sccm) in argon (60 sccm) to reduce the $Fe^{3+}$ ions to Fe metal particles. The resulting reduced metal-carbon composite is pyrophoric, burning spontaneously upon exposure to air.

In experiments, iron-carbon composites prepared by a similar method and having less than 3 wt % iron did not spontaneously combust, while samples having greater than 12 wt % iron always spontaneously combusted. Accordingly, the wt % of iron in the iron-carbon composites prepared by the method in this example should be greater than 3%.

Specific Example

Monolithic Titanium-Carbon Composite

The following process was used to prepare a pyrophoric titanium-carbon composite. The first part involves preparation of the carbon aerogel. In a typical experiment, resorcinol (12.3 g, 0.112 mol) and 37% formaldehyde solution (17.9 g, 0.224 mol) were dissolved in water (0.6 L), followed by the addition of anhydrous sodium carbonate (0.06 g, 0.00056 mol). The reaction mixture was then transferred to glass molds and cured at 80° C. for 72 hours. The resultant organic hydrogels, isolated as bright orange monoliths, were washed with acetone until the water was completely exchanged and then dried by supercritical extraction in carbon dioxide. The organic aerogels were carbonized at 1050° C. for 3 hours under a nitrogen atmosphere. The second part of the process involved preparing the titania sol and forming the composite.

Typically, titanium (IV) ethoxide (1.0 g, 0.0125 mol) and ethanol (3.57 g, 0.0776 mol), hydrochloric acid (71.4 μl), and water (85.7 μl) were mixed in an ice bath, followed by the addition of propylene oxide (0.357 g, 0.00616 mol) to prepare the titania sol. A carbon aerogel monolith (0.05 g) was immersed in the titania sol in a glass vial and held under vacuum to ensure full penetration of the sol in the carbon aerogel. The reaction mixture was then cured at room temperature for 24 hours. The resultant wet titania-carbon composite was then washed in ethanol and dried by supercritical extraction in carbon dioxide. The titania-impregnated carbon foam was then treated with 500 sccm nitrogen gas at 1400° C. to reduce the titania to Ti metal particles. The resulting reduced metal-carbon composite is pyrophoric, burning spontaneously upon exposure to air.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for creating a pyrophoric material, comprising:

thermally activating a carbon foam for creating micropores therein;

contacting the activated carbon foam with a liquid solution comprising a metal salt for depositing metal ions in the carbon foam; and reducing the metal ions in the foam to metal particles, thereby forming a pyrophoric metal-carbon foam composite comprising a carbon foam having micropores and mesopores and a surface area of greater than or equal to about 2000 $m^2$/g, and metal particles in the pores of the carbon foam.

2. A method as recited in claim 1, further comprising forming the carbon foam using a sol-gel chemistry process.

3. A method as recited in claim 2, wherein the sol-gel chemistry includes an acid-catalyzed polymerization of precursors.

4. A method as recited in claim 2, further comprising drying a gel formed using the sol-gel chemistry process, wherein the gel is dried under ambient conditions.

5. A method as recited in claim 2, further comprising pyrolyzing a gel formed using the sol-gel chemistry process for producing the carbon foam, the carbon foam being primarily macroporous.

6. A method as recited in claim 1, wherein the activating is performed by contacting the carbon foam with a heated gas.

7. A method as recited in claim 6, wherein the heated gas is selected from a group consisting of carbon dioxide and steam.

8. A method as recited in claim 1, wherein an internal surface area of the foam after the activating and before the contacting is greater than about 2000 $m^2$/gram.

9. A method as recited in claim 1, further comprising drying the activated carbon foam after the contacting and before the reducing.

10. A method as recited in claim 1, wherein the reducing includes contacting the metal ions with a gaseous reductant.

11. A method as recited in claim 1, further comprising storing the carbon foam with metal particles therein in an inert atmosphere.

12. A method for creating a pyrophoric material, comprising:

forming a carbonaceous gel using a sol-gel chemistry process;

pyrolyzing the gel for producing a primarily macroporous carbon foam;

thermally activating the carbon foam for creating micropores therein;

contacting the activated carbon foam with a liquid solution comprising a metal salt for depositing metal ions in the carbon foam; and reducing the metal ions in the foam to metal particles, thereby forming a pyrophoric metal-carbon foam composite comprising a carbon foam having micropores and mesopores and a surface area of greater than or equal to about 2000 $m^2$/g, and metal particles in the pores of the carbon foam.

13. A method as recited in claim 12, wherein the sol-gel chemistry process includes an acid-catalyzed polymerization of precursors.

14. A method as recited in claim 12, wherein the activating is performed by contacting the carbon foam with a heated gas.

15. A method as recited in claim 14, wherein the heated gas is selected from a group consisting of carbon dioxide and steam.

16. A Method as recited in claim 12, wherein an internal surface area of the foam after the activating and before the contacting is greater than about 2000 $m^2$/gram.

17. A method as recited in claim 12, wherein the reducing includes contacting the metal ions with a gaseous reductant.

18. A method as recited in claim 12, further comprising storing the carbon foam with metal particles therein in an inert atmosphere.

19. A method for creating a pyrophoric material, comprising:

contacting a carbon foam with a solution comprising a metal alkoxide or a solution comprising a metal salt and a proton scavenger, for forming an interpenetrating network of metal oxide gel in the carbon foam;

drying the gel; and pyrolyzing for reducing the metal oxide network to a native metal thereof, thereby forming a pyrophoric metal-carbon foam composite comprising a carbon foam having micropores and mesopores and a surface area of greater than or equal to about 2000 $m^2$/g, and metal particles in the pores of the carbon foam.

20. A method as recited in claim 19, further comprising forming the carbon foam using a sol-gel chemistry process.

21. A method as recited in claim 20, wherein the sol-gel chemistry includes an acid-catalyzed polymerization of precursors.

22. A method as recited in claim 20, further comprising pyrolyzing a gel formed using the sol-gel chemistry process for producing the carbon foam.

23. A method as recited in claim 19, wherein drying the gel includes supercritical extraction.

24. A method as recited in claim 19, further comprising storing the carbon foam in an inert atmosphere after the pyrolyzing.

25. A method for creating a pyrophoric material, comprising:

contacting a carbon foam with a solution comprising a metal alkoxide or a solution comprising a metal salt and a proton scavenger for forming an interpenetrating network of metal oxide gel in the carbon foam, the metal oxide comprising at least one of titanium and iron;

drying the gel using supercritical extraction; and pyrolyzing for reducing the metal oxide network to a native metal thereof, thereby forming a pyrophoric metal-carbon foam composite comprising a carbon foam having micropores and mesopores and a surface area of greater than or equal to about 2000 $m^2/g$, and metal particles in the pores of the carbon foam.

26. A pyrophoric material, comprising:

a pyrophoric metal-carbon foam composite comprising a carbon foam having micropores and mesopores and a surface area of greater than or equal to about 2000 $m^2/g$, and metal particles in the pores of the carbon foam.

27. A material as recited in claim 26, wherein the carbon foam is a pyrollized aerogel or xerogel.

28. A material as recited in claim 26, wherein the carbon foam has micropores characteristic of thermal activation thereof.

29. A material as recited in claim 26, wherein the metal is selected from a group consisting of iron, platinum, titanium, nickel, tin, and zirconium.

30. A material as recited in claim 26, wherein the metal particles are structurally characteristic of liquid solution deposition of a precursor thereof followed by reduction of the precursor.

31. A material as recited in claim 30, wherein the metal particles are coupled directly to the pores of the carbon foam.

32. A material as recited in claim 26, wherein the material consists essentially of the metal particles and the carbon foam.

33. A material as recited in claim 26, wherein the carbon foam is structurally strong enough to enable liquid impregnation and subsequent drying without cracking or shattering thereof.

* * * * *